US006071319A

United States Patent [19]

Morris et al.

[11] Patent Number: 6,071,319

[45] Date of Patent: Jun. 6, 2000

[54] FUEL ADDITIVE COMPOSITIONS CONTAINING AROMATIC ESTERS OF POLYALKYLPHENOXYALKANOLS AND ALIPHATIC AMINES

[75] Inventors: Jack E. Morris, El Cerrito; Majid R. Ahmadi, Pinole, both of Calif.

[73] Assignee: Chevron Chemical Company LLC, San Francisco, Calif.

[21] Appl. No.: 09/218,782

[22] Filed: Dec. 22, 1998

[51] Int. Cl.[7] ..... C10L 1/22; C10L 1/18

[52] U.S. Cl. ..... 44/399; 44/400; 44/432; 44/412

[58] Field of Search ..... 44/399, 400, 432, 44/412

[56] References Cited

U.S. PATENT DOCUMENTS

| | | | |
|---|---|---|---|
| 3,149,933 | 9/1964 | Ley et al. | 44/425 |
| 3,285,855 | 11/1966 | Dexter et al. | 44/390 |
| 3,330,859 | 7/1967 | Dexter et al. | 560/75 |
| 3,434,814 | 3/1969 | Dubeck et al. | 44/413 |
| 3,438,757 | 4/1969 | Honnen et al. | 44/432 |
| 3,565,804 | 2/1971 | Honnen et al. | 508/259 |
| 3,574,576 | 4/1971 | Honnen et al. | 44/432 |
| 3,849,085 | 11/1974 | Kreuz et al. | 44/450 |
| 3,960,515 | 6/1976 | Honnen | 44/432 |
| 4,134,846 | 1/1979 | Machleder et al. | 44/425 |
| 4,320,021 | 3/1982 | Lange | 44/427 |
| 4,328,322 | 5/1982 | Baron | 521/163 |
| 4,347,148 | 8/1982 | Davis | 44/413 |
| 4,386,939 | 6/1983 | Lange | 44/428 |
| 4,832,702 | 5/1989 | Kummer et al. | 44/432 |
| 4,859,210 | 8/1989 | Franz et al. | 44/400 |
| 5,090,914 | 2/1992 | Reardan et al. | 435/188 |
| 5,196,142 | 3/1993 | Mollet et al. | 516/75 |
| 5,196,565 | 3/1993 | Ross | 560/55 |
| 5,211,721 | 5/1993 | Sung et al. | 44/400 |
| 5,380,345 | 1/1995 | Cherpeck | 44/399 |
| 5,407,452 | 4/1995 | Cherpeck | 44/399 |
| 5,427,591 | 6/1995 | Cherpeck | 44/400 |
| 5,618,320 | 4/1997 | Cherpeck | 44/399 |
| 5,713,966 | 2/1998 | Cherpeck | 44/400 |
| 5,749,929 | 5/1998 | Cherpeck et al. | 44/399 |

*Primary Examiner*—Jerry D. Johnson
*Attorney, Agent, or Firm*—Claude J. Caroli

[57] ABSTRACT

A fuel additive composition comprising:

(a) an aromatic ester compound of the formula:

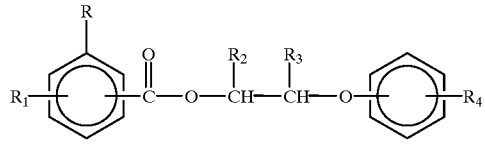

or a fuel soluble salt thereof, wherein R is hydroxy, nitro or —$(CH_2)_x$—$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) an aliphatic hydrocarbyl-substituted amine having at least one basic nitrogen atom, wherein the hydrocarbyl group has a number average molecular weight of about 400 to about 1,000.

The fuel additive compositions of this invention are useful as fuel additives for the prevention and control of engine deposits.

81 Claims, No Drawings

FUEL ADDITIVE COMPOSITIONS CONTAINING AROMATIC ESTERS OF POLYALKYLPHENOXYALKANOLS AND ALIPHATIC AMINES

BACKGROUND OF THE INVENTION

Field of the Invention

This invention relates to fuel additive compositions containing aromatic esters of polyalkylphenoxyalkanols and aliphatic hydrocarbyl-substituted amines. In a further aspect, this invention relates to the use of these additive compositions in fuel compositions to prevent and control engine deposits.

Description of the Related Art

It is well known that automobile engines tend to form deposits on the surface of engine components, such as carburetor ports, throttle bodies, fuel injectors, intake ports and intake valves, due to the oxidation and polymerization of hydrocarbon fuel. These deposits, even when present in relatively minor amounts, often cause noticeable driveability problems, such as stalling and poor acceleration. Moreover, engine deposits can significantly increase an automobile's fuel consumption and production of exhaust pollutants. Therefore, the development of effective fuel detergents or "deposit control" additives to prevent or control such deposits is of considerable importance and numerous such materials are known in the art.

For example, aliphatic hydrocarbon-substituted phenols are known to reduce engine deposits when used in fuel compositions. U.S. Pat. No. 3,849,085, issued Nov. 19, 1974 to Kreuz et al., discloses a motor fuel composition comprising a mixture of hydrocarbons in the gasoline boiling range containing about 0.01 to 0.25 volume percent of a high molecular weight aliphatic hydrocarbon-substituted phenol in which the aliphatic hydrocarbon radical has an average molecular weight in the range of about 500 to 3,500. This patent teaches that gasoline compositions containing minor amounts of an aliphatic hydrocarbon-substituted phenol not only prevent or inhibit the formation of intake valve and port deposits in a gasoline engine, but also enhance the performance of the fuel composition in engines designed to operate at higher operating temperatures with a minimum of decomposition and deposit formation in the manifold of the engine.

Similarly, U.S. Pat. No. 4,134,846, issued Jan. 16, 1979 to Machleder et al., discloses a fuel additive composition comprising a mixture of (1) the reaction product of an aliphatic hydrocarbon-substituted phenol, epichlorohydrin and a primary or secondary mono- or polyamine, and (2) a polyalkylene phenol. This patent teaches that such compositions show excellent carburetor, induction system and combustion chamber detergency and, in addition, provide effective rust inhibition when used in hydrocarbon fuels at low concentrations.

Amino phenols are also known to function as detergents/dispersants, antioxidants and anti-corrosion agents when used in fuel compositions. U.S. Pat. No. 4,320,021, issued Mar. 16, 1982 to R. M. Lange, for example, discloses amino phenols having at least one substantially saturated hydrocarbon-based substituent of at least 30 carbon atoms. The amino phenols of this patent are taught to impart useful and desirable properties to oil-based lubricants and normally liquid fuels.

Similarly, U.S. Pat. No. 3,149,933, issued Sep. 22, 1964 to K. Ley et al., discloses hydrocarbon-substituted amino phenols as stabilizers for liquid fuels.

U.S. Pat. No. 4,386,939, issued Jun. 7, 1983 to R. M. Lange, discloses nitrogen-containing compositions prepared by reacting an amino phenol with at least one 3- or 4-membered ring heterocyclic compound in which the hetero atom is a single oxygen, sulfur or nitrogen atom, such as ethylene oxide. The nitrogen-containing compositions of this patent are taught to be useful as additives for lubricants and fuels.

Nitro phenols have also been employed as fuel additives. For example, U.S. Pat. No. 4,347,148, issued Aug. 31, 1982 to K. E. Davis, discloses nitro phenols containing at least one aliphatic substituent having at least about 40 carbon atoms. The nitro phenols of this patent are taught to be useful as detergents, dispersants, antioxidants and demulsifiers for lubricating oil and fuel compositions.

Similarly, U.S. Pat. No. 3,434,814, issued Mar. 25, 1969 to M. Dubeck et al., discloses a liquid hydrocarbon fuel composition containing a major quantity of a liquid hydrocarbon of the gasoline boiling range and a minor amount sufficient to reduce exhaust emissions and engine deposits of an aromatic nitro compound having an alkyl, aryl, aralkyl, alkanoyloxy, alkoxy, hydroxy or halogen substituent.

More recently, certain poly(oxyalkylene) esters have been shown to reduce engine deposits when used in fuel compositions. U.S. Pat. No. 5,211,721, issued May 18, 1993 to R. L. Sung et al., for example, discloses an oil soluble polyether additive comprising the reaction product of a polyether polyol with an acid represented by the formula RCOOH in which R is a hydrocarbyl radical having 6 to 27 carbon atoms. The poly(oxyalkylene) ester compounds of this patent are taught to be useful for inhibiting carbonaceous deposit formation, motor fuel hazing, and as ORI inhibitors when employed as soluble additives in motor fuel compositions.

Poly(oxyalkylene) esters of amino- and nitrobenzoic acids are also known in the art. For example, U.S. Pat. No. 2,714,607, issued Aug. 2, 1955 to M. Matter, discloses polyethoxy esters of aminobenzoic acids, nitrobenzoic acids and other isocyclic acids. These polyethoxy esters are taught to have excellent pharmacological properties and to be useful as anesthetics, spasmolytics, analeptics and bacteriostatics.

Similarly, U.S. Pat. No. 5,090,914, issued Feb. 25, 1992 to D. T. Reardan et al., discloses poly(oxyalkylene) aromatic compounds having an amino or hydrazinocarbonyl substituent on the aromatic moiety and an ester, amide, carbamate, urea or ether linking group between the aromatic moiety and the poly(oxyalkylene) moiety. These compounds are taught to be useful for modifying macromolecular species such as proteins and enzymes.

U.S. Pat. No. 4,328,322, issued Sep. 22, 1980 to R. C. Baron, discloses amino- and nitrobenzoate esters of oligomeric polyols, such as poly(ethylene) glycol. These materials are used in the production of synthetic polymers by reaction with a polyisocyanate.

U.S. Pat. No. 4,859,210, issued Aug. 22, 1989 to Franz et al., discloses fuel compositions containing (1) one or more polybutyl or polyisobutyl alcohols wherein the polybutyl or polyisobutyl group has a number average molecular weight of 324 to 3,000, or (2) a poly(alkoxylate) of the polybutyl or polyisobutyl alcohol, or (3) a carboxylate ester of the polybutyl or polyisobutyl alcohol. This patent further teaches that when the fuel composition contains an ester of a polybutyl or polyisobutyl alcohol, the ester-forming acid group may be derived from saturated or unsaturated, aliphatic or aromatic, acyclic or cyclic mono- or polycarboxylic acids.

U.S. Pat. Nos. 3,285,855, and 3,330,859 issued Nov. 15, 1966 and Jul. 11, 1967 respectively, to Dexter et al., disclose alkyl esters of dialkyl hydroxybenzoic and hydroxyphenylalkanoic acids wherein the ester moiety contains from 6 to 30 carbon atoms. These patents teach that such esters are useful for stabilizing polypropylene and other organic material normally subject to oxidative deterioration. Similar alkyl esters containing hindered dialkyl hydroxyphenyl groups are disclosed in U.S. Pat. No. 5,196,565, which issued Mar. 23, 1993 to Ross.

U.S. Pat. No. 5,196,142, issued March 23,1993 to Mollet et al., discloses alkyl esters of hydroxyphenyl carboxylic acids wherein the ester moiety may contain up to 23 carbon atoms. This patent teaches that such compounds are useful as antioxidants for stabilizing emulsion-polymerized polymers.

Commonly assigned U.S. Pat. No. 5,407,452, issued Apr. 18, 1995, discloses certain poly(oxyalkylene) nitro and aminoaromatic esters having from 5 to 100 oxyalkylene units and teach the use of such compounds as fuel additives for the prevention and control of engine deposits.

Similarly, commonly assigned U.S. Pat. No. 5,427,591, issued Jun. 27, 1995 discloses certain poly(oxyalkylene) hydroxyaromatic esters which are useful as fuel additives to control engine deposits.

In addition, commonly assigned U.S. Pat. No. 5,380,345, issued Jan. 10, 1995, discloses certain polyalkyl nitro and aminoaromatic esters useful as deposit control additives for fuels. Moreover, commonly assigned U.S. Pat. No. 5,713,966, issued Feb. 3, 1998, and corresponding International Application Publication No. WO 95/11955, published May 4, 1995, disclose certain polyalkyl hydroxyaromatic esters which are also useful as deposit control fuel additives.

Aliphatic hydrocarbyl-substituted amines are also well known in the art as fuel additives for the prevention and control of engine deposits. For example, U.S. Pat. No. 3,438,757 to Honnen et al. discloses branched chain aliphatic hydrocarbon N-substituted amines and alkylene polyamines having a molecular weight in the range of about 425 to 10,000, preferably about 450 to 5,000, which are useful as detergents and dispersants in hydrocarbon liquid fuels for internal combustion engines.

Aromatic esters of polyalkylphenoxyalkanols are also known in the art as fuel additives for the prevention and control of engine deposits. Thus, commonly assigned U.S. Pat. No. 5,618,320, issued Apr. 8, 1997 to Cherpeck et al., discloses hydroxy, nitro, amino and aminomethyl substituted aromatic esters of polyalkylphenoxyalkanols which are useful as additives in fuel compositions for the control of engine deposits, particularly intake valve deposits.

In addition, commonly assigned U.S. Pat. No. 5,749,929, issued May 12, 1998 to Cherpeck et al., and corresponding International Application Publication No. WO 97/43357, published Nov. 20, 1997, disclose fuel additive compositions comprising aromatic esters of polyalkylphenoxyalkanols in combination with poly(oxyalkylene) amines, which are useful for the control of engine deposits.

SUMMARY OF THE INVENTION

It has now been discovered that the combination of certain aromatic esters of polyalkylphenoxyalkanols with certain aliphatic hydrocarbyl-substituted amines affords a unique fuel additive composition which provides excellent control of engine deposits, especially intake valve deposits.

Accordingly, the present invention provides a novel fuel additive composition comprising:

(a) an aromatic ester compound having the following formula or a fuel soluble salt thereof:

(I)

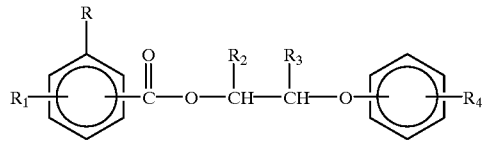

wherein R is hydroxy, nitro or $—(CH_2)_x—NR_5R_6$, wherein $R_5$ and $R_6$ are independently hydrogen or lower alkyl having 1 to 6 carbon atoms and x is 0 or 1;

$R_1$ is hydrogen, hydroxy, nitro or $—NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) an aliphatic hydrocarbyl-substituted amine having at least one basic nitrogen atom, wherein the hydrocarbyl group has a number average molecular weight of about 400 to about 1,000.

The present invention further provides a fuel composition comprising a major amount of hydrocarbons boiling in the gasoline or diesel range and an effective deposit-controlling amount of a fuel additive composition of the present invention.

The present invention additionally provides a fuel concentrate comprising an inert stable oleophilic organic solvent boiling in the range of from about 150° F. to 400° F. and from about 10 to 70 weight percent of a fuel additive composition of the present invention.

Among other factors, the present invention is based on the surprising discovery that the unique combination of certain aromatic esters of polyalkylphenoxyalkanols with certain aliphatic hydrocarbyl-substituted amines provides excellent control of engine deposits, especially on intake valves, when employed as additives in fuel compositions.

DETAILED DESCRIPTION OF THE INVENTION

A. The Aromatic Ester of Polyalkylphenoxyalkanols

The aromatic ester component of the present additive composition is an aromatic ester of a polyalkylphenoxyalkanol and has the following general formula:

(I)

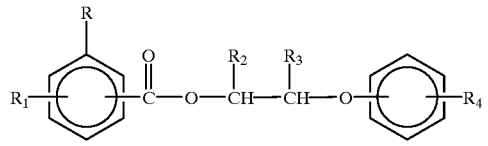

or a fuel-soluble salt thereof, wherein R, $R_1$, $R_2$, $R_3$ and $R_4$ are as defined hereinabove.

Based on performance (e.g. deposit control), handling properties and performance/cost effectiveness, the preferred aromatics ester compounds employed in the present invention are those wherein R is nitro, amino, N-alkylamino, or $—CH_2NH_2$ (aminomethyl). More preferably, R is a nitro, amino or $—CH_2NH_2$ group. Most preferably, R is an amino or $—CH_2NH_2$ group, especially amino. Preferably, $R_1$ is hydrogen, hydroxy, nitro or amino. More preferably, $R_1$ is hydrogen or hydroxy. Most preferably, $R_1$ is hydrogen. Preferably, $R_4$ is a polyalkyl group having an average molecular weight in the range of about 500 to 3,000, more preferably about 700 to 3,000, and most preferably about 900 to 2,500. Preferably, the compound has a combination of preferred substituents.

Preferably, one of $R_2$ and $R_3$ is hydrogen or lower alkyl of 1 to 4 carbon atoms, and the other is hydrogen. More preferably, one of $R_2$ and $R_3$ is hydrogen, methyl or ethyl, and the other is hydrogen. Most preferably, $R_2$ is hydrogen, methyl or ethyl, and $R_3$ is hydrogen.

When R and/or $R_1$ is an N-alkylamino group, the alkyl group of the N-alkylamino moiety preferably contains 1 to 4 carbon atoms. More preferably, the N-alkylamino is N-methylamino or N-ethylamino.

Similarly, when R and/or $R_1$ is an N,N-dialkylamino group, each alkyl group of the N,N-dialkylamino moiety preferably contains 1 to 4 carbon atoms. More preferably, each alkyl group is either methyl or ethyl. For example, particularly preferred N,N-dialkylamino groups are N,N-dimethylamino, N-ethyl-N-methylamino and N,N-diethylamino groups.

A further preferred group of compounds are those wherein R is amino, nitro, or —$CH_2NH_2$ and $R_1$ is hydrogen or hydroxy. A particularly preferred group of compounds are those wherein R is amino, $R_1$, $R_2$ and $R_3$ are hydrogen, and $R_4$ is a polyalkyl group derived from polyisobutene.

It is preferred that the R substituent is located at the meta or, more preferably, the para position of the benzoic acid moiety, i.e., para or meta relative to the carbonyloxy group. When $R_1$ is a substituent other than hydrogen, it is particularly preferred that this $R_1$ group be in a meta or para position relative to the carbonyloxy group and in an ortho position relative to the R substituent. Further, in general, when $R_1$ is other than hydrogen, it is preferred that one of R or $R_1$ is located para to the carbonyloxy group and the other is located meta to the carbonyloxy group. Similarly, it is preferred that the $R_4$ substituent on the other phenyl ring is located para or meta, more preferably para, relative to the ether linking group.

The compounds employed in the present invention will generally have a sufficient molecular weight so as to be non-volatile at normal engine intake valve operating temperatures (about 200°–250° C.). Typically, the molecular weight of the compounds employed in this invention will range from about 700 to about 3,500, preferably from about 700 to about 2,500.

Fuel-soluble salts of the compounds of formula I can be readily prepared for those compounds containing an amino or substituted amino group and such salts are contemplated to be useful for preventing or controlling engine deposits. Suitable salts include, for example, those obtained by protonating the amino moiety with a strong organic acid, such as an alkyl- or arylsulfonic add. Preferred salts are derived from toluenesulfonic acid and methanesulfonic acid.

When the R or $R_1$ substituent is a hydroxy group, suitable salts can be obtained by deprotonation of the hydroxy group with a base. Such salts include salts of alkali metals, alkaline earth metals, ammonium and substituted ammonium salts. Preferred salts of hydroxy-substituted compounds include alkali metal, alkaline earth metal and substituted ammonium salts.

Definitions

As used herein, the following terms have the following meanings unless expressly stated to the contrary.

The term "amino" refers to the group: —$NH_2$.

The term "N-alkylamino" refers to the group: —$NHR_a$ wherein $R_a$ is an alkyl group.

The term "N,N-dialkylamino" refers to the group: —$NR_bR_c$, wherein $R_b$ and $R_c$ are alkyl groups.

The term "alkyl" refers to both straight- and branched-chain alkyl groups. The term "lower alkyl" refers to alkyl groups having 1 to about 6 carbon atoms and includes primary, secondary and tertiary alkyl groups. Typical lower alkyl groups include, for example, methyl, ethyl, n-propyl, isopropyl, n-butyl, sec-butyl, t-butyl, n-pentyl, n-hexyl and the like.

The term "polyalkyl" refers to an alkyl group which is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The term "fuel" or "hydrocarbon fuel" refers to normally liquid hydrocarbons having boiling points in the range of gasoline and diesel fuels.

General Synthetic Procedures

The polyalkylphenoxyalkyl aromatic esters employed in this invention may be prepared by the following general methods and procedures. It should be appreciated that where typical or preferred process conditions (e.g., reaction temperatures, times, mole ratios of reactants, solvents, pressures, etc.) are given, other process conditions may also be used unless otherwise stated. Optimum reaction conditions may vary with the particular reactants or solvents used, but such conditions can be determined by one skilled in the art by routine optimization procedures.

Those skilled in the art will also recognize that it may be necessary to block or protect certain functional groups while conducting the following synthetic procedures. In such cases, the protecting group will serve to protect the functional group from undesired reactions or to block its undesired reaction with other functional groups or with the reagents used to carry out the desired chemical transformations. The proper choice of a protecting group for a particular functional group will be readily apparent to one skilled in the art. Various protecting groups and their introduction and removal are described, for example, in T. W. Greene and P. G. M. Wuts, Protective Groups in Organic Synthesis, Second Edition, Wiley, New York, 1991, and references cited therein.

In the present synthetic procedures, a hydroxyl group will preferably be protected, when necessary, as the benzyl or tert-butyidimethylsilyl ether. Introduction and removal of these protecting groups is well described in the art. Amino groups may also require protection and this may be accomplished by employing a standard amino protecting group, such as a benzyloxycarbonyl or a trifluoroacetyl group. Additionally, as will be discussed in further detail hereinbelow, the aromatic esters employed in this invention having an amino group on the aromatic moiety will generally be prepared from the corresponding nitro derivative. Accordingly, in many of the following procedures, a nitro group will serve as a protecting group for the amino moiety.

Moreover, the aromatic ester compounds employed in this invention having a —$CH_2NH_2$ group on the aromatic moiety will generally be prepared from the corresponding cyano derivative, —CN. Thus, in many of the following procedures, a cyano group will serve as a protecting group for the —$CH_2NH_2$ moiety.

Synthesis

The polyalkylphenoxyalkyl aromatic esters employed in the present invention may be prepared by a process which initially involves hydroxyalkylation of a polyalkylphenol of the formula:

(II)

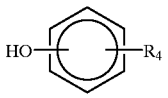

wherein $R_4$ is as defined herein, with an alkylene carbonate of the formula:

(III)

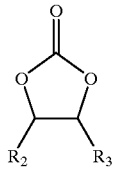

wherein $R_2$ and $R_3$ are defined herein, in the presence of a catalytic amount of an alkali metal hydride or hydroxide, or alkali metal salt, to provide a polyalkylphenoxyalkanol of the formula:

(IV)

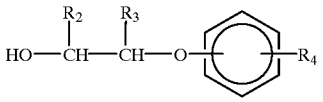

wherein $R_2$, $R_3$ and $R_4$ are as defined herein.

The polyalkylphenols of formula 11 are well known materials and are typically prepared by the alkylation of phenol with the desired polyolefin or chlorinated polyolefin. A further discussion of polyalkylphenols can be found, for example, in U.S. Pat. No. 4,744,921 and U.S. Pat. No. 5,300,701.

Accordingly, the polyalkylphenols of formula 11 may be prepared from the corresponding olefins by conventional procedures. For example, the polyalkylphenols of formula 11 above may be prepared by reacting the appropriate olefin or olefin mixture with phenol in the presence of an alkylating catalyst at a temperature of from about 25° C. to 150° C., and preferably 30° C. to 100° C. either neat or in an essentially inert solvent at atmospheric pressure. A preferred alkylating catalyst is boron trifluoride. Molar ratios of reactants may be used. Alternatively, molar excesses of phenol can be employed, i.e., 2 to 3 equivalents of phenol for each equivalent of olefin with unreacted phenol recycled. The latter process maximizes monoalkylphenol. Examples of inert solvents include heptane, benzene, toluene, chlorobenzene and 250 thinner which is a mixture of aromatics, paraffins and naphthenes.

The polyalkyl substituent on the polyalkylphenols employed in the invention is generally derived from polyolefins which are polymers or copolymers of mono-olefins, particularly 1-mono-olefins, such as ethylene, propylene, butylene, and the like. Preferably, the mono-olefin employed will have 2 to about 24 carbon atoms, and more preferably, about 3 to 12 carbon atoms. More preferred mono-olefins include propylene, butylene, particularly isobutylene, 1-octene and 1-decene. Polyolefins prepared from such mono-olefins include polypropylene, polybutene, especially polyisobutene, and the polyalphaolefins produced from 1-octene and 1-decene.

The preferred polyisobutenes used to prepare the presently employed polyalkylphenols are polyisobutenes which comprise at least about 20% of the more reactive methylvinylidene isomer, preferably at least 50% and more preferably at least 70%. Suitable polyisobutenes include those prepared using $BF_3$ catalysts. The preparation of such polyisobutenes in which the methylvinylidene isomer comprises a high percentage of the total composition is described in U.S. Pat. Nos. 4,152,499 and 4,605,808. Such polyisobutenes, known as "reactive" polyisobutenes, yield high molecular weight alcohols in which the hydroxyl group is at or near the end of the hydrocarbon chain. Examples of suitable polyisobutenes having a high alkylvinylidene content include Ultravis 30, a polyisobutene having a number average molecular weight of about 1300 and a methylvinylidene content of about 74%, and Ultravis 10, a polyisobutene having a number average molecular weight of about 950 and a methylvinylidene content of about 76%, both available from British Petroleum.

The alkylene carbonates of formula III are known compounds which are available commercially or can be readily prepared using conventional procedures. Suitable alkylene carbonates include ethylene carbonate, propylene carbonate, 1,2-butylene carbonate, 2,3-butylene carbonate, and the like. A preferred alkylene carbonate is ethylene carbonate.

The catalyst employed in the reaction of the polyalkylphenol and alkylene carbonate may be any of the well known hydroxyalkylation catalysts. Typical hydroxyalkylation catalysts include alkali metal hydrides, such as lithium hydride, sodium hydride and potassium hydride, alkali metal hydroxides, such as sodium hydroxide and potassium hydroxide, and alkali metal salts, for example, alkali metal halides, such as sodium chloride and potassium chloride, and alkali metal carbonates, such as sodium carbonate and potassium carbonate. The amount of catalyst employed will generally range from about 0.01 to 1.0 equivalent, preferably from about 0.05 to 0.3 equivalent.

The polyalkylphenol and alkylene carbonate are generally reacted in essentially equivalent amounts in the presence of the hydroxyalkylation catalyst at a temperature in the range of about 100° C. to 210° C., and preferably from about 150° C. to about 170° C. The reaction may take place in the presence or absence of an inert solvent.

The time of reaction will vary depending on the particular alkylphenol and alkylene carbonate reactants, the catalyst used and the reaction temperature. Generally, the reaction time will range from about two hours to about five hours. The progress of the reaction is typically monitored by the evolution of carbon dioxide. At the completion of the reaction, the polyalkylphenoxyalkanol product is isolated using conventional techniques.

The hydroxyalkylation reaction of phenols with alkylene carbonates is well known in the art and is described, for example, in U.S. Pat. Nos. 2,987,555; 2,967,892; 3,283,030 and 4,341,905.

Alternatively, the polyalkylphenoxyalkanol product of formula IV may be prepared by reacting the polyalkylphenol of formula II with an alkylene oxide of the formula:

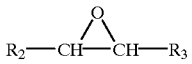

(V)

wherein $R_2$ and $R_3$ are as defined herein, in the presence of a hydroxyalkylation catalyst as described above. Suitable alkylene oxides of formula V include ethylene oxide, propylene oxide, 1,2-butylene oxide, 2,3-butylene oxide, and the like. A preferred alkylene oxide is ethylene oxide.

In a manner similar to the reaction with alkylene carbonate, the polyalkylphenol and alkylene oxide are reacted in essentially equivalent or equimolar amounts in the presence of 0.01 to 1.0 equivalent of a hydroxyalkylation catalyst, such as sodium or potassium hydride, at a temperature in the range of about 30° C. to about 150° C., for about 2 to about 24 hours. The reaction may be conducted in the presence or absence of a substantially anhydrous inert solvent. Suitable solvents include toluene, xylene, and the like. Generally, the reaction conducted at a pressure sufficient to contain the reactants and any solvent present, typically at atmospheric or higher pressure. Upon completion of the reaction, the polyalkylphenoxyalkanol is isolated by conventional procedures.

The polyalkylphenoxyalkanol of formula IV is subsequently reacted with a substituted benzoic acid of formula VI to provide the aromatic ester compounds of formula I. This reaction can be represented as follows:

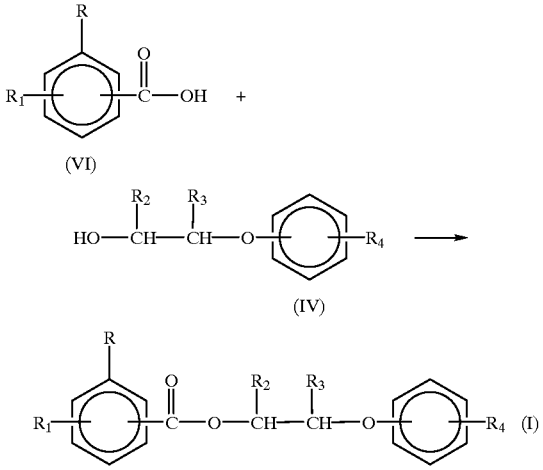

wherein R, $R_1$, $R_2$, $R_3$ and $R_4$ are as defined herein, and wherein any hydroxy or amino substituent on the substituted benzoic acid of formula VI is preferably protected with a suitable protecting group, for example, a benzyl or nitro group, respectively. Moreover, a $—CH_2NH_2$ substituent on the aromatic ring will preferably be protected by the use of a cyano group, CN.

This reaction is typically conducted by contacting a polyalkylphenoxyalkanol of formula IV with about 0.25 to about 1.5 molar equivalents of the corresponding substituted and protected benzoic acid of formula VI in the presence of an acidic catalyst at a temperature in the range of about 70° C. to about 160° C. for about 0.5 to about 48 hours. Suitable acid catalysts for this reaction include p-toluene sulfonic acid, methanesulfonic acid and the like. Optionally, the reaction can be conducted in the presence of an inert solvent, such as benzene, toluene and the like. The water generated by this reaction is preferably removed during the course of the reaction, for example, by azeotropic distillation.

The substituted benzoic acids of formula VI are generally known compounds and can be prepared from known compounds using conventional procedures or obvious modifications thereof. Representative acids suitable for use as starting materials include, for example, 2-aminobenzoic acid (anthranilic acid), 3-aminobenzoic acid, 4-aminobenzoic acid, 3-amino-4-hydroxybenzoic acid, 4-amino-3-hydroxybenzoic acid, 2-nitrobenzoic acid, 3-nitrobenzoic acid, 4-nitrobenzoic acid, 3-hydroxy-4-nitrobenzoic acid, 4-hydroxy-3-nitrobenzoic acid. When the R substituent is $—CH_2—NR_5R_6$, suitable starting materials include 4-cyanobenzoic acid and 3-cyanobenzoic acid.

Preferred substituted benzoic acids include 3-nitrobenzoic acid, 4-nitrobenzoic acid, 3-hydroxy-4-nitrobenzoic acid, 4-hydroxy-3-nitrobenzoic acid, 3-cyanobenzoic acid and 4-cyanobenzoic acid.

The compounds of formula I or their suitably protected analogs also can be prepared by reacting the polyalkylphenoxyalkanol of formula IV with an acid halide of the substituted benzoic acid of formula VI such as an acid chloride or acid bromide. This can be represented by the following reaction equation:

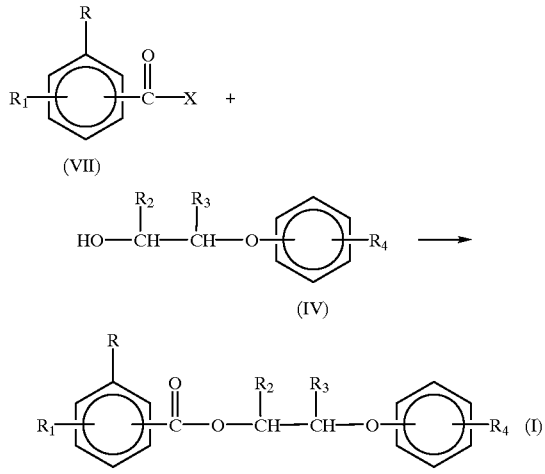

wherein X is halide, typically chloride or bromide, and R, $R_1$, $R_2$, $R_3$ and $R_4$ are as defined herein above, and wherein any hydroxy or amino substituents on the acid halide of formula VII are preferably protected with a suitable protection group, for example, benzyl or nitro, respectively. Also, when R is $—CH_2NR_5R_6$, a suitable starting material is a cyanobenzoyl halide.

Typically, this reaction is conducted by contacting the polyalkylphenoxyalkanol of formula IV with about 0.9 to about 1.5 molar equivalents of the acid halide of formula VII in an inert solvent, such as, for example, toluene, dichloromethane, diethyl ether, and the like, at a temperature in the range of about 25° C. to about 150° C. The reaction is generally complete in about 0.5 to about 48 hours. Preferably, the reaction is conducted in the presence of a sufficient amount of an amine capable of neutralizing the acid generated during the reaction, such as, for example, triethylamine, di(isopropyl)ethylamine, pyridine or 4-dimethylaminopyridine.

When the benzoic acids of formula VI or acid halides of formula VII contain a hydroxyl group, protection of the aromatic hydroxyl groups may be accomplished using well-known procedures. The choice of a suitable protecting group for a particular hydroxybenzoic carboxylic acid will be apparent to those skilled in the art. Various protecting groups, and their introduction and removal, are described, for example, in T. W. Greene and P. G. M. Wuts, *Protective Groups in Organic Synthesis,* Second Edition, Wiley, New York, 1991, and references cited therein.

After completion of the esterification, deprotection of the aromatic hydroxyl group can also be accomplished using conventional procedures. Appropriate conditions for this deprotection step will depend upon the protecting group(s) utilized in the synthesis and will be readily apparent to those skilled in the art. For example, benzyl protecting groups may be removed by hydrogenolysis under 1 to about 4 atmospheres of hydrogen in the presence of a catalyst, such as palladium on carbon. Typically, this deprotection reaction is conducted in an inert solvent, preferably a mixture of ethyl acetate and acetic acid, at a temperature of from about 0° C. to about 40° C. for about 1 to about 24 hours.

When the benzoic acids of formula VI or acyl halides of formula VII have a free amino group (—$NH_2$) on the phenyl moiety, it is generally desirable to first prepare the corresponding nitro compound (i.e., where R and/or $R_1$ is a nitro group) using the above-described synthetic procedures, including preparation of the acyl halides, and then reduce the nitro group to an amino group using conventional procedures. Aromatic nitro groups may be reduced to amino groups using a number of procedures that are well known in the art. For example, aromatic nitro groups may be reduced under catalytic hydrogenation conditions; or by using a reducing metal, such as zinc, tin, iron and the like, in the presence of an acid, such as dilute hydrochloric acid. Generally, reduction of the nitro group by catalytic hydrogenation is preferred. Typically, this reaction is conducted using about 1 to 4 atmospheres of hydrogen and a platinum or palladium catalyst, such as palladium on carbon. The reaction is typically carried out at a temperature of about 0° C. to about 100° C. for about 1 to 24 hours in an inert solvent, such as ethanol, ethyl acetate and the like. Hydrogenation of aromatic nitro groups is discussed in further detail in, for example, P. N. Rylander, Catalytic Hydrogenation in *Organic Synthesis,* pp.113–137, Academic Press (1979); and *Organic Synthesis, Collective Vol. I,* Second Edition, pp. 240–241, John Wiley & Sons, Inc. (1941); and references cited therein.

Likewise, when the benzoic acids of formula VI or acyl halides of formula VII contain a —$CH_2NH_2$ group on the phenyl moiety, it is generally desirable to first prepare the corresponding cyano compounds (i.e., where R and/or $R_1$ is a —CN group), and then reduce the cyano group to a —$H_2NH_2$ group using conventional procedures. Aromatic cyano groups may be reduced to $CH_2NH_2$ groups using procedures well known in the art. For example, aromatic cyano groups may be reduced under catalytic hydrogenation conditions similar to those described above for reduction of aromatic nitro groups to amino groups. Thus, this reaction is typically conducted using about 1 to 4 atmospheres of hydrogen and a platinum or palladium catalyst, such as palladium on carbon. Another suitable catalyst is a Lindlar catalyst, which is palladium on calcium carbonate. The hydrogenation may be carried out at temperatures of about 0° C. to about 100° C. for about 1 to 24 hours in an inert solvent such as ethanol, ethyl acetate, and the like. Hydrogenation of aromatic cyano groups is further discussed in the references cited above for reduction of aromatic nitro groups.

The acyl halides of formula VII can be prepared by contacting the corresponding benzoic acid compound of formula VI with an inorganic acid halide, such as thionyl chloride, phosphorous trichloride, phosphorous tribromide, or phosphorous pentachloride; or with oxalyl chloride. Typically, this reaction will be conducted using about 1 to 5 molar equivalents of the inorganic acid halide or oxalyl chloride, either neat or in an inert solvent, such as diethyl ether, at a temperature in the range of about 20° C. to about 80° C. for about 1 to about 48 hours. A catalyst, such as N,N-dimethylformamide, may also be used in this reaction. Again it is preferred to first protect any hydroxy or amino substituents before converting the benzoic acid to the acyl halide.

B. The Aliphatic Hydrocarbyl-Substituted Amine

The aliphatic hydrocarbyl-substituted amine component of the present fuel additive composition is a straight or branched chain hydrocarbyl-substituted amine having at least one basic nitrogen atom wherein the hydrocarbyl group has a number average molecular weight of about 400 to about 1,000. Typically, such aliphatic hydrocarbyl-substituted amines will be of sufficient molecular weight so as to be nonvolatile at normal engine intake valve operating temperatures, which are generally in the range of about 1 75° C. to 300° C.

Preferably, the hydrocarbyl group will have a number average molecular weight in the range of about 450 to about 1,000. The hydrocarbyl group will also preferably be branched chain.

When employing a branched-chain hydrocarbyl amine, the hydrocarbyl group is preferably derived from polymers of $C_2$ to $C_6$ olefins. Such branched-chain hydrocarbyl groups will ordinarily be prepared by polymerizing olefins of from 2 to 6 carbon atoms (ethylene being copolymerized with another olefin so as to provide a branched-chain). The branched chain hydrocarbyl group will generally have at least 1 branch per 6 carbon atoms along the chain, preferably at least 1 branch per 4 carbon atoms along the chain and, more preferably, at least 1 branch per 2 carbon atoms along the chain. The preferred branched-chain hydrocarbyl groups are derived from polypropylene and polyisobutylene, especially polyisobutylene. The branches will usually be of from 1 to 2 carbon atoms, preferably 1 carbon atom, that is, methyl.

In most instances, the branched-chain hydrocarbyl amines are not a pure single product, but rather a mixture of compounds having an average molecular weight. Usually, the range of molecular weights will be relatively narrow and peaked near the indicated molecular weight.

The amine component of the aliphatic hydrocarbyl-substituted amines may be derived from ammonia, a monoamine or a polyamine. The monoamine or polyamine component embodies a broad class of amines having from 1 to about 12 amine nitrogen atoms and from 1 to about 40 carbon atoms with a carbon to nitrogen ratio between about 1:1 and 10:1. Generally, the monoamine will contain from 1 to about 40 carbon atoms and the polyamine will contain from 2 to about 12 amine nitrogen atoms and from 2 to about 40 carbon atoms. In most instances, the amine component is not a pure single product, but rather a mixture of compounds having a major quantity of the designated amine. For the more complicated polyamines, the compositions will be a mixture of amines having as the major product the compound indicated and having minor amounts of analogous compounds. Suitable monoamines and polyamines are described more fully below.

When the amine component is a polyamine, it will preferably be a polyalkylene polyamine, including alkylenediamine. Preferably, the alkylene group will contain from 2 to 6 carbon atoms, more preferably from 2 to 3 carbon atoms. Examples of such polyamines include ethylene diamine, diethylene triamine, triethylene tetramine and tetraethylene pentamine. Preferred polyamines are ethylene diamine and diethylene triamine.

Particularly preferred branched-chain hydrocarbyl amines include polyisobutenyl ethylene diamine and polyisobutyl monoamine, wherein the polyisobutyl group is substantially saturated and the amine moiety is derived from ammonia.

The aliphatic hydrocarbyl amines employed in the fuel composition of the invention are prepared by conventional procedures known in the art. Such aliphatic hydrocarbyl amines and their preparations are described in detail in U.S. Pat. Nos. 3,438,757; 3,565,804; 3,574,576; 3,848,056; 3,960,515; and 4,832,702, the disclosures of which are incorporated herein by reference.

Typically, the hydrocarbyl-substituted amines employed in this invention are prepared by reacting a hydrocarbyl halide, such as a hydrocarbyl chloride, with ammonia or a primary or secondary amine to produce the hydrocarbyl-substituted amine.

Alternatively, when the hydrocarbyl group is derived from polybutene or polyisobutene, the aliphatic hydrocarbyl-substituted amines employed in this invention may be prepared by first hydroformylating an appropriate polybutene or polyisobutene with a rhodium or cobalt catalyst in the presence of carbon monoxide and hydrogen, and then subjecting the resulting oxo product to a Mannich reaction or amination under hydrogenating conditions, as described, for example, in U.S. Pat. No. 4,832,702 to Kummer et al.

As noted above, the amine component of the presently employed aliphatic hydrocarbyl-substituted amine is derived from a nitrogen-containing compound selected from ammonia, a monoamine having from 1 to about 40 carbon atoms, and a polyamine having from 2 to about 12 amine nitrogen atoms and from 2 to about 40 carbon atoms. The nitrogen-containing compound is generally reacted with a hydrocarbyl halide to produce the hydrocarbyl-substituted amine fuel additive finding use within the scope of the present invention. The amine component provides a hydrocarbyl amine reaction product with, on average, at least about one basic nitrogen atom per product molecule, i.e., a nitrogen atom titratable by a strong acid.

Preferably, the amine component is derived from a polyamine having from 2 to about 12 amine nitrogen atoms and from 2 to about 40 carbon atoms. The polyamine preferably has a carbon-to-nitrogen ratio of from about 1:1 to 10:1.

The polyamine may be substituted with substituents selected from (a) hydrogen, (b) hydrocarbyl groups of from 1 to about 10 carbon atoms, (c) acyl groups of from 2 to about 10 carbon atoms, and (d) monoketo, monohydroxy, mononitro, monocyano, lower alkyl and lower alkoxy derivatives of (b) and (c). "Lower", as used in terms like lower alkyl or lower alkoxy, means a group containing from 1 to about 6 carbon atoms. At least one of the substituents on one of the basic nitrogen atoms of the polyamine is hydrogen, e.g., at least one of the basic nitrogen atoms of the polyamine is a primary or secondary amino nitrogen.

The term "hydrocarbyl", as used in describing the polyamine moiety on the aliphatic amine employed in this invention, denotes an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation. The substituted polyamines of the present invention are generally, but not necessarily, N-substituted polyamines. Exemplary hydrocarbyl groups and substituted hydrocarbyl groups include alkyls such as methyl, ethyl, propyl, butyl, isobutyl, pentyl, hexyl, octyl, etc., alkenyls such as propenyl, isobutenyl, hexenyl, octenyl, etc., hydroxyalkyls, such as 2-hydroxyethyl, 3-hydroxypropyl, hydroxyisopropyl, 4-hydroxybutyl, etc., ketoalkyls, such as 2-ketopropyl, 6-ketooctyl, etc., alkoxy and lower alkenoxy alkyls, such as ethoxyethyl, ethoxypropyl, propoxyethyl, propoxypropyl, diethyleneoxymethyl, triethyleneoxyethyl, tetraethyleneoxyethyl, diethyleneoxyhexyl, etc. The aforementioned acyl groups (c) are such as propionyl, acetyl, etc. The more preferred substituents are hydrogen, $C_1$–$C_6$ alkyls and $C_1$–$C_6$ hydroxyalkyls.

In a substituted polyamine, the substituents are found at any atom capable of receiving them. The substituted atoms, e.g., substituted nitrogen atoms, are generally geometrically unequivalent, and consequently the substituted amines finding use in the present invention can be mixtures of mono- and poly-substituted polyamines with substituent groups situated at equivalent and/or unequivalent atoms.

The more preferred polyamine finding use within the scope of the present invention is a polyalkylene polyamine, including alkylene diamine, and including substituted polyamines, e.g., alkyl and hydroxyalkyl-substituted polyalkylene polyamine. Preferably, the alkylene group contains from 2 to 6 carbon atoms, there being preferably from 2 to 3 carbon atoms between the nitrogen atoms. Such groups are exemplified by ethylene, 1,2-propylene, 2,2-dimethylpropylene, trimethylene, 1,3,2-hydroxypropylene, etc. Examples of such polyamines include ethylene diamine, diethylene triamine, di(trimethylene) triamine, dipropylene triamine, triethylene tetraamine, tripropylene tetraamine, tetraethylene pentamine, and pentaethylene hexamine. Such amines encompass isomers such as branched-chain polyamines and previously-mentioned substituted polyamines, including hydroxy- and hydrocarbyl-substituted polyamines. Among the polyalkylene polyamines, those containing 2–12 amino nitrogen atoms and 2–24 carbon atoms are especially preferred, and the $C_2$–$C_3$ alkylene polyamines are most preferred, that is, ethylene diamine, polyethylene polyamine, propylene diamine and polypropylene polyamine, and in particular, the lower polyalkylene polyamines, e.g., ethylene diamine, dipropylene triamine, etc. Particularly preferred polyalkylene polyamines are ethylene diamine and diethylene triamine.

The amine component of the presently employed aliphatic amine fuel additive also may be derived from heterocyclic polyamines, heterocyclic substituted amines and substituted heterocyclic compounds, wherein the heterocycle comprises one or more 5–6 membered rings containing oxygen and/or nitrogen. Such heterocyclic rings may be saturated or unsaturated and substituted with groups selected from the aforementioned (a), (b), (c) and (d). The heterocyclic compounds are exemplified by piperazines, such as 2-methylpiperazine, N-(2-hydroxyethyl)-piperazine, 1,2-bis-(N-piperazinyl) ethane and N,N'-bis(N-piperazinyl)piperazine, 2-methylimidazoline, 3-aminopiperidine, 3-aminopyridine, N-(3-aminopropyl)-morpholine, etc. Among the heterocyclic compounds, the piperazines are preferred.

Typical polyamines that can be used to form the aliphatic hydrocarbyl-substituted amine additives employed in this invention by reaction with a hydrocarbyl halide include the following: ethylene diamine, 1,2-propylene diamine, 1,3-propylene diamine, diethylene triamine, triethylene tetramine, hexamethylene diamine, tetraethylene pentamine, dimethylaminopropylene diamine, N-(beta-aminoethyl)

piperazine, N-(beta-aminoethyl)piperidine, 3-amino-N-ethylpiperidine, N-(beta-aminoethyl) morpholine, N,N'-di (beta-aminoethyl)piperazine, N,N'-di(beta-aminoethyl) imidazolidone-2, N-(beta-cyanoethyl) ethane-1,2-diamine, 1-amino-3,6,9-triazaoctadecane, 1-amino-3,6-diaza-9-oxadecane, N-(beta-aminoethyl) diethanolamine, N'-acetylmethyl-N-(beta-aminoethyl) ethane-1,2-diamine, N-acetonyl-1,2-propanediamine, N-(beta-nitroethyl)-1,3-propane diamine, i,3-dimethyl-5(beta-aminoethyl) hexahydrotriazine, N-(beta-aminoethyl)-hexahydrotriazine, 5-(beta-aminoethyl)-1 ,3,5-dioxazine, 2-(2-aminoethylamino)ethanol, and 2-[2-(2-aminoethylamino) ethylamino]ethanol.

Alternatively, the amine component of the presently employed aliphatic hydrocarbyl-substituted amine may be derived from an amine having the formula:

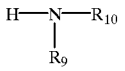

wherein $R_9$ and $R_{10}$ are independently selected from the group consisting of hydrogen and hydrocarbyl of 1 to about 20 carbon atoms and, when taken together, Rg and $R_{10}$ may form one or more 5- or 6-membered rings containing up to about 20 carbon atoms. Preferably, $R_9$ is hydrogen and $R_{10}$ is a hydrocarbyl group having 1 to about 10 carbon atoms. More preferably, $R_9$ and $R_{10}$ are hydrogen. The hydrocarbyl groups may be straight-chain or branched and may be aliphatic, alicyclic, aromatic or combinations thereof. The hydrocarbyl groups may also contain one or more oxygen atoms.

An amine of the above formula is defined as a "secondary amine" when both $R_9$ and $R_{10}$ are hydrocarbyl. When $R_9$ is hydrogen and $R_{10}$ is hydrocarbyl, the amine is defined as a "primary amine"; and when both $R_9$ and $R_{10}$ are hydrogen, the amine is ammonia.

Primary amines useful in preparing the aliphatic hydrocarbyl-substituted amine fuel additives of the present invention contain 1 nitrogen atom and I to about 20 carbon atoms, preferably 1 to 10 carbon atoms. The primary amine may also contain one or more oxygen atoms.

Preferably, the hydrocarbyl group of the primary amine is methyl, ethyl, propyl, butyl, pentyl, hexyl, octyl, 2-hydroxyethyl or 2-methoxyethyl. More preferably, the hydrocarbyl group is methyl, ethyl or propyl.

Typical primary amines are exemplified by N-methylamine, N-ethylamine, N-n-propylamine, N-isopropylamine, N-n-butylamine, N-isobutylamine, N-sec-butylamine, N-tert-butylamine, N-n-pentylamine, N-cyclopentylamine, N-n-hexylamine, N-cyclohexylamine, N-octylamine, N-decylamine, N-dodecylamine, N-octadecylamine, N-benzylamine, N-(2-phenylethyl) amine, 2-aminoethanol, 3-amino-1-proponal, 2-(2-aminoethoxy)ethanol, N-(2-methoxyethyl)amine, N-(2-ethoxyethyl)amine, and the like. Preferred primary amines are N-methylamine, N-ethylamine and N-n-propylamine.

The amine component of the presently employed aliphatic hydrocarbyl-substituted amine fuel additive may also be derived from a secondary amine. The hydrocarbyl groups of the secondary amine may be the same or different and will generally contain 1 to about 20 carbon atoms, preferably 1 to about 10 carbon atoms. One or both of the hydrocarbyl groups may also contain one or more oxygen atoms.

Preferably, the hydrocarbyl groups of the secondary amine are independently selected from the group consisting of methyl, ethyl, propyl, butyl, pentyl, hexyl, 2-hydroxyethyl and 2-methoxyethyl. More preferably, the hydrocarbyl groups are methyl, ethyl or propyl.

Typical secondary amines which may be used in this invention include N,N-dimethylamine, N,N-diethylamine, N,N-di-n-propylamine, N,N-diisopropylamine, N,N-di-n-butylamine, N,N-di-sec-butylamine, N,N-di-n-pentylamine, N,N-di-n-hexylamine, N,N-dicyclohexylamine, N,N-dioctylamine, N-ethyl-N-methylamine; N-methyl-N-n-propylamine, N-n-butyl-N-methylamine, N-methyl-N-octylamine, N-ethyl-N-isopropylamine, N-ethyl-N-octylamine, N,N-di(2-hydroxyethyl)amine, N,N-di(3-hydroxypropyl)amine, N,N-di(ethoxyethyl)amine, N,N-di (propoxyethyl)amine, and the like. Preferred secondary amines are N,N-dimethylamine, N,N-diethylamine and N,N-di-n-propylamine.

Cyclic secondary amines may also be employed to form the aliphatic amine additives of this invention. In such cyclic compounds, $R_9$ and $R_{10}$ of the formula hereinabove, when taken together, form one or more 5- or 6-membered rings containing up to about 20 carbon atoms. The ring containing the amine nitrogen atom is generally saturated, but may be fused to one or more saturated or unsaturated rings. The rings may be substituted with hydrocarbyl groups of from 1 to about 10 carbon atoms and may contain one or more oxygen atoms.

Suitable cyclic secondary amines include piperidine, 4-methylpiperidine, pyrrolidine, morpholine, 2,6-dimethylmorpholine, and the like.

In many instances, the amine component is not a single compound but a mixture in which one or several compounds predominate with the average composition indicated. For example, tetraethylene pentamine prepared by the polymerization of aziridine or the reaction of dichloroethylene and ammonia will have both lower and higher amine members, e.g., triethylene tetraamine, substituted piperazines and pentaethylene hexamine, but the composition will be mainly tetraethylene pentamine and the empirical formula of the total amine composition will closely approximate that of tetraethylene pentamine. Finally, in preparing the compounds employed in this invention using a polyamine, where the various nitrogen atoms of the polyamine are not geometrically equivalent, several substitutional isomers are possible and are encompassed within the final product. Methods of preparation of amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99–116.

Preferred aliphatic hydrocarbyl-substituted amines suitable for use in the present invention are hydrocarbyl-substituted polyalkylene polyamines having the formula:

$$R_{11}NH—(R_{12}—NH)_n—H$$

wherein $R_{11}$ is an aliphatic hydrocarbyl group having a number average molecular weight of about 400 to about 1,000; $R_{12}$ is alkylene of from 2 to 6 carbon atoms; and n is an integer of from 0 to about 10.

Preferably, $R_{11}$ is a hydrocarbyl group having a number average molecular weight of about 450 to about 1,000. Preferably, $R_{12}$ is alkylene of from 2 to 3 carbon atoms and n is preferably an integer of from 1 to 6. In another preferred embodiment, n is 0, that is, the amine is a monoamine.

Fuel Compositions

The fuel additive composition of the present invention will generally be employed in hydrocarbon fuels to prevent and control engine deposits, particularly intake valve deposits. The proper concentration of additive necessary to achieve the desired deposit control varies depending upon the type of fuel employed, the type of engine, and the presence of other fuel additives.

Generally, the present fuel additive composition will be employed in a hydrocarbon fuel in a concentration ranging from about 25 to about 5,000 parts per million (ppm) by weight, preferably from 100 to 2,500 ppm.

In terms of individual components, hydrocarbon fuel containing the fuel additive composition of this invention will generally contain about 10 to 2,500 ppm of the polyalkylphenoxyalkyl aromatic ester component and about 10 to 2,500 ppm of the aliphatic hydrocarbyl-substituted amine component. The ratio of the polyalkylphenoxyalkyl aromatic ester to aliphatic amine will generally range from about 0.05:1 to about 5:1, and will preferably be about 0.05:1 to about 2:1.

The fuel additive composition of the present invention may be formulated as a concentrate using an inert stable oleophilic (i.e., dissolves in gasoline) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols containing about 3 to 8 carbon atoms, such as isopropanol, isobutylcarbinol, n-butanol and the like, in combination with hydrocarbon solvents are also suitable for use with the present additives. In the concentrate, the amount of the additive will generally range from about 10 to about 70 weight percent, preferably 10 to 50 weight percent, more preferably from 20 to 40 weight percent.

In gasoline fuels, other fuel additives may be employed with the additive composition of the present invention, including, for example, oxygenates, such as t-butyl methyl ether, antiknock agents, such as methylcyclopentadienyl manganese tricarbonyl, and other dispersants/detergents, such as poly(oxyalkylene) amines, or succinimides. Additionally, antioxidants, metal deactivators, demulsifiers and carburetor or fuel injector detergents may be present.

In diesel fuels, other well-known additives can be employed, such as pour point depressants, flow improvers, cetane improvers, and the like.

A fuel-soluble, nonvolatile carrier fluid or oil may also be used with the fuel additive composition of this invention. The carrier fluid is a chemically inert hydrocarbon-soluble liquid vehicle which substantially increases the nonvolatile residue (NVR), or solvent-free liquid fraction of the fuel additive composition while not overwhelmingly contributing to octane requirement increase. The carrier fluid may be a natural or synthetic fluid, such as mineral oil, refined petroleum oils, synthetic polyalkanes and alkenes, including hydrogenated and unhydrogenated polyalphaolefins, and synthetic polyoxyalkylene-derived fluids, such as those described, for example, in U.S. Pat. No. 4,191,537 to Lewis, and polyesters, such as those described, for example, in U.S. Pat. Nos. 3,756,793 to Robinson and 5,004,478 to Vogel et al., and in European Pat. Application Nos. 356,726, published Mar. 7, 1990, and 382,159, published Aug. 16, 1990.

These carrier fluids are believed to act as a carrier for the fuel additive composition of the present invention and to assist in removing and retarding deposits. The carrier fluid may also exhibit synergistic deposit control properties when used in combination with the fuel additive composition of this invention.

The carrier fluids are typically employed in amounts ranging from about 25 to about 5000 ppm by weight of the hydrocarbon fuel, preferably from 100 to 3000 ppm of the fuel. Preferably, the ratio of carrier fluid to deposit control additive will range from about 0.2:1 to about 10:1, more preferably from 0.5:1 to 3:1.

When employed in a fuel concentrate, carrier fluids will generally be present in amounts ranging from about 20 to about 60 weight percent, preferably from 30 to 50 weight percent.

PREPARATIONS AND EXAMPLES

A further understanding of the invention can be had in the following nonlimiting Examples. Wherein unless expressly stated to the contrary, all temperatures and temperature ranges refer to the Centigrade system and the term "ambient" or "room temperature" refers to about 20° C. to 25° C. The term "percent" or "%" refers to weight percent and the term "mole" or "moles" refers to gram moles. The term "equivalent" refers to a quantity of reagent equal in moles, to the moles of the preceding or succeeding reactant recited in that example in terms of finite moles or finite weight or volume. Where given, proton-magnetic resonance spectrum (p.m.r. or n.m.r.) were determined at 300 mHz, signals are assigned as singlets (s), broad singlets (bs), doublets (d), double doublets (dd), triplets (t), double triplets (dt), quartets (q), and multiplets (m), and cps refers to cycles per second.

EXAMPLE 1

Preparation of Polyisobutyl Phenol

To a flask equipped with a magnetic stirrer, reflux condenser, thermometer, addition funnel and nitrogen inlet was added 203.2 grams of phenol. The phenol was warmed to 40° C. and the heat source was removed. Then, 73.5 milliliters of boron trifluoride etherate was added dropwise. 1040 grams of Ultravis 10 Polyisobutene (molecular weight 950, 76% methylvinylidene, available from British Petroleum) was dissolved in 1,863 milliliters of hexane. The polyisobutene was added to the reaction at a rate to maintain the temperature between 22° C. to 27° C. The reaction mixture was stirred for 16 hours at room temperature. Then, 400 milliliters of concentrated ammonium hydroxide was added, followed by 2,000 milliliters of hexane. The reaction mixture was washed with water (3×2,000 milliliters), dried over magnesium sulfate, filtered and the solvents removed under vacuum to yield 1,056.5 grams of a crude reaction product. The crude reaction product was determined to contain 80% of the desired product by proton NMR and chromatography on silica gel eluting with hexane, followed by hexane: ethylacetate: ethanol (93:5:2).

EXAMPLE 2

Preparation of

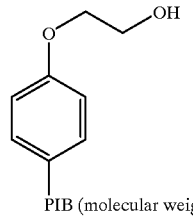

PIB (molecular weight ~ 950)

1.1 grams of a 35 weight percent dispersion of potassium hydride in mineral oil and 4- polyisobutyl phenol (99.7 grams, prepared as in Example 1) were added to a flask equipped with a magnetic stirrer, reflux condenser, nitrogen inlet and thermometer. The reaction was heated at 130° C. for one hour and then cooled to 100° C. Ethylene carbonate (8.6 grams) was added and the mixture was heated at 160° C. for 16 hours. The reaction was cooled to room temperature and one milliliter of isopropanol was added. The reaction was diluted with one liter of hexane, washed three times with water and once with brine. The organic layer was dried over anhydrous magnesium sulfate, filtered and the solvents removed in vacuo to yield 98.0 grams of the desired product as a yellow oil.

EXAMPLE 3

Preparation of

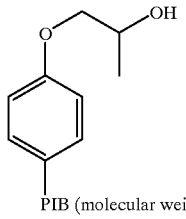

15.1 grams of a 35 weight percent dispersion of potassium hydride in mineral oil and 4- polyisobutyl phenol (1378.5 grams, prepared as in Example 1) were added to a flask equipped with a mechanical stirrer, reflux condensor, nitrogen inlet and thermometer. The reaction was heated at 130° C. for one hour and then cooled to 100° C. Propylene carbonate (115.7 milliliters) was added and the mixture was heated at 1 60° C. for 16 hours. The reaction was cooled to room temperature and ten milliliters of isopropanol were added. The reaction was diluted with ten liters of hexane, washed three times with water and once with brine. The organic layer was dried over anhydrous magnesium sulfate, filtered and the solvents removed in vacuo to yield 1301.7 grams of the desired product as a yellow oil.

EXAMPLE 4

Preparation of

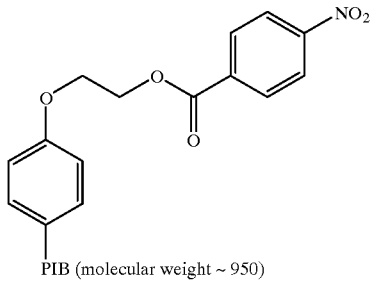

To a flask equipped with a magnetic stirrer, thermometer, Dean-Stark trap, reflux condenser and nitrogen inlet was added 15.0 grams of the alcohol from Example 2, 2.6 grams of 4-nitrobenzoic acid and 0.24 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 15.0 grams of the desired product as a brown oil. The oil was chromatographed on silica gel, eluting with hexane/ethyl acetate (9:1) to afford 14.0 grams of the desired ester as a yellow oil. $^1$H NMR ($CDCl_3$) d 8.3 (AB quartet, 4H), 7.25 (d, 2H), 6.85 (d, 2H), 4.7 (t, 2H), 4.3 (t, 2H), 0.7–1.6 (m, 137H).

EXAMPLE 5

Preparation of

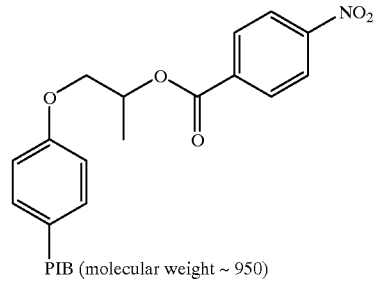

To a flask equipped with a magnetic stirrer, thermometer, Dean-Stark trap, reflux condensor and nitrogen inlet was added 15.0 grams of the alcohol from Example 3, 2.7 grams of 4-nitrobenzoic acid and 0.23 grams of p-toluenesulfonic acid. The mixture was stirred at 130° C. for sixteen hours, cooled to room temperature and diluted with 200 mL of hexane. The organic phase was washed twice with saturated aqueous sodium bicarbonate followed by once with saturated aqueous sodium chloride. The organic layer was then dried over anhydrous magnesium sulfate, filtered and the solvents removed in vacuo to yield 16.0 grams of the desired product as a brown oil. The oil was chromatographed on silica gel, eluting with hexane/ethyl acetate (8:2) to afford 15.2 grams of the desired ester as a brown oil. $^1$ H NMR ($CDCl_3$) d 8.2 (AB quartet, 4H), 7.25 (d, 2H), 6.85 (d, 2H), 5.55 (hx, 1H), 4.1 (t, 2H), 0.6–1.8 (m, 140H).

EXAMPLE 6

Preparation of

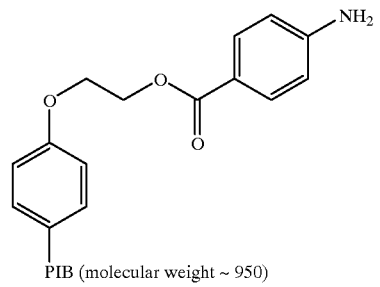

A solution of 9.4 grams of the product from Example 4 in 100 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 7.7 grams of the desired product as a yellow oil. $^1$ H NMR ($CDCl_3$) d 7.85 (d, 2H), 7.3 (d, 2H), 6.85 (d, 2H), 6.6 (d, 2H), 4.6 (t, 2H), 4.25 (t, 2H), 4.05 (bs, 2H), 0.7–1.6 (m, 137H).

EXAMPLE 7

Preparation of

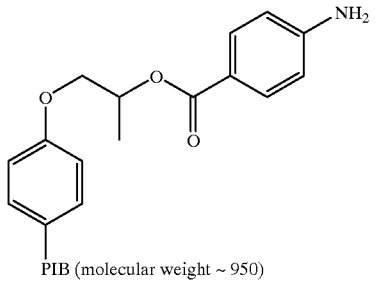

A solution of 15.2 grams of the product from Example 5 in 200 milliliters of ethyl acetate containing 1.0 gram of 10% palladium on charcoal was hydrogenolyzed at 35–40 psi for 16 hours on a Parr low-pressure hydrogenator. Catalyst filtration and removal of the solvent in vacuo yield 15.0 grams of the desired product as a brown oil. $^1$H NMR (CDCI3/D20) d 7.85 (d, 2H), 7.25 (d, 2H), 6.85 (d, 2H), 6.6 (d, 2H), 5.4 (hx, 11H), 3.8–4.2 (m, 4H), 0.6–1.8 (m, 140H).

EXAMPLE 8

Single-Cylinder Engine Test

The test compounds were blended in gasoline and their deposit reducing capacity determined in an ASTM/CFR single-cylinder engine test.

A Waukesha CFR single-cylinder engine was used. Each run was carried out for 15 hours, at the end of which time the intake valve was removed, washed with hexane and weighed. The previously determined weight of the clean valve was subtracted from the weight of the valve at the end of the run. The differences between the two weights is the weight of the deposit. A lesser amount of deposit indicates a superior additive. The operating conditions of the test were as follows: water jacket temperature 200° F.; intake manifold vacuum of 12 in. Hg, air-fuel ratio of 12, ignition spark timing of 40° BTC; engine speed is 1800 rpm; the crankcase oil is a commercial SAE 30 oil.

The amount of carbonaceous deposit in milligrams on the intake valves is reported for each of the test compounds in Table I.

TABLE I

| Run No. | Sample | Concentration (ppma) | Intake Valve Deposits, mg |
|---|---|---|---|
| 1 | Base Fuel | | |
| 2 | Aromatic Ester[1] | 14 | 211 |
| 3 | Aromatic Ester[1] | 28 | 150 |
| 4 | Amine A[2] | 14 | 217 |
| 5 | Amine A | 28 | 198 |
| 6 | Aromatic Ester[1]/Amine A | 14/14 | 104 |
| 7 | Amine B[3] | 14 | 301 |
| 8 | Amine B | 28 | 277 |
| 9 | Aromatic Ester[1]/Amine B | 14/14 | 107 |
| 10 | Amine C[4] | 14 | 226 |
| 11 | Amine C | 28 | 143 |

TABLE I-continued

| Run No. | Sample | Concentration (ppma) | Intake Valve Deposits, mg |
|---|---|---|---|
| 12 | Aromatic Ester[1]/Amine C | 14/14 | 106 |
| 13 | Amine D[5] | 28 | 210 |
| 14 | Aromatic Ester[1]/Amine D | 14/14 | 159 |

[1]Aromatic Ester = 4-polyisobutylphenoxyethyl para-amino benzoate prepared as described in Example 6.
[2]Amine A = polyisobutene ethylene diamine, wherein the polyisobutenyl group has an average molecular weight of about 460, prepared as described in U.S. Pat. No. 3,438,757
[3]Amine B = polyisobutenyl ethylene diamine, wherein the polyisobutenyl group has an average molecular weight of about 950, prepared as described in U.S. Pat. No. 3,438,757.
[4]Amine C = polyisobutyl monoamine, wherein the polyisobutyl group has an average molecular weight of about 950, prepared as described in U.S. Pat. No. 4,832,702.
[5]Amine D = polyisobutenyl ethylene diamine, wherein the polyisobutenyl group has an average molecular weight of about 1,300, prepared as described in U.S. Pat. No. 3,438,757.

The base fuel employed in the above single-cylinder engine tests was a regular octane unleaded gasoline containing no fuel detergent. The test compounds were admixed with the base fuel at the indicated concentrations. Run Nos. 2, 4, 7 and 10 also contained 14 ppm, and Run Nos. 3, 5, 6, 8, 9 and 11–14 contained 28 ppm, of a dodecylphenyl poly (oxypropylene) monool carrier fluid having an average molecular weight of about 1000.

The data in Table I demonstrates that the combination of a polyalkylphenoxyalkyl aromatic ester and an aliphatic hydrocarbyl-substituted amine in accordance with the present invention has a synergistic effect and gives significantly better intake valve deposit control than either component individually. Moreover, the data in Table I further demonstrates that the combination of aromatic ester with the lower molecular weight aliphatic amines employed in this invention (amines A, B and C) gives substantially better intake valve deposit control than the combination of aromatic ester with a higher molecular weight aliphatic amine (amine D), wherein the aliphatic hydrocarbyl substituent has an average molecular weight of about 1,300.

What is claimed is:

1. A fuel additive composition comprising:

(a) an aromatic ester compound of the formula:

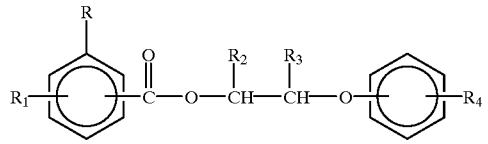

or a fuel soluble salt thereof, wherein R is hydroxy, nitro or —$(CH_2)_x$—$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) an aliphatic hydrocarbyl-substituted amine having at least one basic nitrogen atom, wherein the hydrocarbyl group has a number average molecular weight of about 400 to about 1,000.

2. The fuel additive composition according to claim 1, wherein R is nitro, amino or —$CH_2NH_2$.

3. The fuel additive composition according to claim 2, wherein R is amino, or —$CH_2NH_2$.

4. The fuel additive composition according to claim 3, wherein R is amino.

5. The fuel additive composition according to claim 1, wherein $R_1$ is hydrogen, hydroxy, nitro or amino.

6. The fuel additive composition according to claim 5, wherein $R_1$ is hydrogen or hydroxy.

7. The fuel additive composition according to claim 6, wherein $R_1$ is hydrogen.

8. The fuel additive composition according to claim 1, wherein one of $R_2$ and $R_3$ is hydrogen or lower alkyl of 1 to 4 carbon atoms, and the other is hydrogen.

9. The fuel additive composition according to claim 8, wherein one of $R_2$ and $R_3$ is hydrogen, methyl or ethyl, and the other is hydrogen.

10. The fuel additive composition according to claim 9, wherein $R_2$ is hydrogen, methyl or ethyl, and $R_3$ is hydrogen.

11. The fuel additive composition according to claim 1, wherein $R_4$ is a polyalkyl group having an average molecular weight in the range of about 500 to 3,000.

12. The fuel additive composition according to claim 11, wherein $R_4$ is a polyalkyl group having an average molecular weight in the range of about 700 to 3,000.

13. The fuel additive composition according to claim 12, wherein $R_4$ is a polyalkyl group having an average molecular weight in the range of about 900 to 2,500.

14. The fuel additive composition according to claim 1, wherein $R_4$ is a polyalkyl group derived from polypropylene, polybutene, or a polyalphaolefin oligomer of 1-octene or 1-decene.

15. The fuel additive composition according to claim 14, wherein $R_4$ is a polyalkyl group derived from polyisobutene.

16. The fuel additive composition according to claim 15, wherein the polyisobutene contains at least about 20% of a methylvinylidene isomer.

17. The fuel additive composition according to claim 1, wherein R is amino, $R_1$, $R_2$ and $R_3$ are hydrogen and $R_4$ is a polyalkyl group derived from polyisobutene.

18. The fuel additive composition according to claim 1, wherein the hydrocarbyl substituent on the aliphatic amine of component (b) has a number average molecular weight of about 450 to about 1,000.

19. The fuel additive composition according to claim 1, wherein the aliphatic amine of component (b) is a branched chain hydrocarbyl-substituted amine.

20. The fuel additive composition according to claim 19, wherein the aliphatic amine of component (b) is a polyisobutyl or polyisobutenyl amine.

21. The fuel additive composition according to claim 19, wherein the amine moiety of the aliphatic amine is derived from a polyamine having from 2 to 12 amine nitrogen atoms and from 2 to 40 carbon atoms.

22. The fuel additive composition according to claim 21, wherein the polyamine is a polyalkylene polyamine having 2 to 12 amine nitrogen atoms and 2 to 24 carbon atoms.

23. The fuel additive composition according to claim 22, wherein the polyalkylene polyamine is selected from the group consisting of ethylene diamine, diethylene triamine, triethylene tetramine and tetraethylene pentamine.

24. The fuel additive composition according to claim 23, wherein the polyalkylene polyamine is ethylene diamine or diethylene triamine.

25. The fuel additive composition according to claim 24, wherein the aliphatic amine of component (b) is a polyisobutenyl ethylene diamine.

26. The fuel additive composition according to claim 20, wherein the aliphatic amine of component (b) is a polyisobutyl monoamine.

27. A fuel composition comprising a major amount of hydrocarbons boiling in the gasoline or diesel range and an effective deposit-controlling amount of a fuel additive composition comprising:

(a) an aromatic ester compound of the formula:

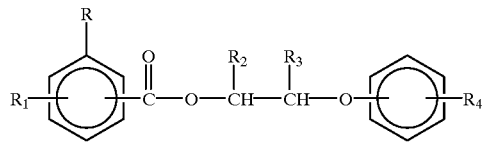

or a fuel soluble salt thereof, wherein R is hydroxy, nitro or —$(CH_2)_x$—$NR_5R_6$, wherein Rs and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) an aliphatic hydrocarbyl-substituted amine having at least one basic nitrogen atom, wherein the hydrocarbyl group has a number average molecular weight of about 400 to about 1,000.

28. The fuel composition according to claim 27, wherein R is nitro, amino or —$CH_2NH_2$.

29. The fuel composition according to claim 28, wherein R is amino, or —$CH_2NH_2$.

30. The fuel composition according to claim 29, wherein R is amino.

31. The fuel composition according to claim 27, wherein $R_1$ is hydrogen, hydroxy, nitro or amino.

32. The fuel composition according to claim 31, wherein $R_1$ is hydrogen or hydroxy.

33. The fuel composition according to claim 32, wherein $R_1$ is hydrogen.

34. The fuel composition according to claim 27, wherein one of $R_2$ and $R_3$ is hydrogen or lower alkyl of 1 to 4 carbon atoms, and the other is hydrogen.

35. The fuel composition according to claim 34, wherein one of $R_2$ and $R_3$ is hydrogen, methyl or ethyl, and the other is hydrogen.

36. The fuel composition according to claim 35, wherein $R_2$ is hydrogen, methyl or ethyl, and $R_3$ is hydrogen.

37. The fuel composition according to claim 27, wherein $R_4$ is a polyalkyl group having an average molecular weight in the range of about 500 to 3,000.

38. The fuel composition according to claim 37, wherein $R_4$ is a polyalkyl group having an average molecular weight in the range of about 700 to 3,000.

39. The fuel composition according to claim 38, wherein $R_4$ is a polyalkyl group having an average molecular weight in the range of about 900 to 2,500.

40. The fuel composition according to claim 27, wherein $R_4$ is a polyalkyl group derived from polypropylene, polybutene, or a polyalphaolefin oligomer of 1-octene or 1-decene.

41. The fuel composition according to claim 40, wherein $R_4$ is a polyalkyl group derived from polyisobutene.

42. The fuel composition according to claim 41, wherein the polyisobutene contains at least about 20% of a methylvinylidene isomer.

43. The fuel composition according to claim 27, wherein R is amino, $R_1$, $R_2$ and $R_3$ are hydrogen and $R_4$ is a polyalkyl group derived from polyisobutene.

44. The fuel composition according to claim 27, wherein the composition contains from about 10 to about 2,500 parts per million by weight of said aromatic ester compound and about 10 to about 2,500 parts per million by weight of said aliphatic hydrocarbyl-substituted amine.

45. The fuel composition according to claim 27, where the composition further contains from about 25 to about 5,000 parts per million by weight of a fuel-soluble, nonvolatile carrier fluid.

46. The fuel composition according to claim 27, wherein the hydrocarbyl substituent on the aliphatic amine of component (b) has a number average molecular weight of about 450 to about 1,000.

47. The fuel composition according to claim 27, wherein the aliphatic amine of component (b) is a branched chain hydrocarbyl-substituted amine.

48. The fuel composition according to claim 47, wherein the aliphatic amine of component (b) is a polyisobutyl or polyisobutenyl amine.

49. The fuel composition according to claim 47, wherein the amine moiety of the aliphatic amine is derived from a polyamine having from 2 to 12 amine nitrogen atoms and from 2 to 40 carbon atoms.

50. The fuel composition according to claim 49, wherein the polyamine is a polyalkylene polyamine having 2 to 12 amine nitrogen atoms and 2 to 24 carbon atoms.

51. The fuel composition according to claim 50, wherein the polyalkylene polyamine is selected from the group consisting of ethylene diamine, diethylene triamine, triethylene tetramine and tetraethylene pentamine.

52. The fuel composition according to claim 51, wherein the polyalkylene polyamine is ethylene diamine or diethylene triamine.

53. The fuel composition according to claim 52, wherein the aliphatic amine of component (b) is a polyisobutenyl ethylene diamine.

54. The fuel composition according to claim 48, wherein the aliphatic amine of component (b) is a polyisobutyl monoamine.

55. A fuel concentrate comprising an inert stable oleophilic organic solvent boiling in the range of from about 150° F. to 400° F. and from about 10 to about 70 weight percent of a fuel additive composition comprising:

(a) an aromatic ester compound of the formula:

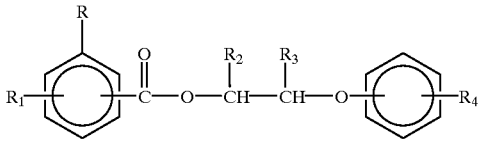

or a fuel soluble salt thereof, wherein R is hydroxy, nitro or —$(CH_2)_x$—$NR_5R_6$, wherein $R_5$ and $R_6$ are independently hydrogen or lower alkyl having 1 to 6 carbon atoms and x is 0 or 1;

$R_1$ is hydrogen, hydroxy, nitro or —$NR_7R_8$, wherein $R_7$ and $R_8$ are independently hydrogen or lower alkyl having 1 to 6 carbon atoms;

$R_2$ and $R_3$ are independently hydrogen or lower alkyl having 1 to 6 carbon atoms; and $R_4$ is a polyalkyl group having an average molecular weight in the range of about 450 to 5,000; and (b) an aliphatic hydrocarbyl-substituted amine having at least one basic nitrogen atom, wherein the hydrocarbyl group has a number average molecular weight of about 400 to about 1,000.

56. The fuel concentrate according to claim 55, wherein R is nitro, amino or —$CH_2NH_2$.

57. The fuel concentrate according to claim 56, wherein R is amino, or —$CH_2NH_2$.

58. The fuel concentrate according to claim 57, wherein R is amino.

59. The fuel concentrate according to claim 55, wherein $R_1$ is hydrogen, hydroxy, nitro or amino.

60. The fuel concentrate according to claim 59, wherein $R_1$ is hydrogen or hydroxy.

61. The fuel concentrate according to claim 60, wherein $R_1$ is hydrogen.

62. The fuel concentrate according to claim 55, wherein one of $R_2$ and $R_3$ is hydrogen or lower alkyl of 1 to 4 carbon atoms, and the other is hydrogen.

63. The fuel concentrate according to claim 62, wherein one of $R_2$ and $R_3$ is hydrogen, methyl or ethyl, and the other is hydrogen.

64. The fuel concentrate according to claim 63, wherein $R_2$ is hydrogen, methyl or ethyl, and $R_3$ is hydrogen.

65. The fuel concentrate according to claim 55, wherein $R_4$ is a polyalkyl group having an average molecular weight in the range of about 500 to 3,000.

66. The fuel concentrate according to claim 65, wherein $R_4$ is a polyalkyl group having an average molecular weight in the range of about 700 to 3,000.

67. The fuel concentrate according to claim 66, wherein $R_4$ is a polyalkyl group having an average molecular weight in the range of about 900 to 2,500.

68. The fuel concentrate according to claim 55, wherein $R_4$ is a polyalkyl group derived from polypropylene, polybutene, or a polyalphaolefin oligomer of 1-octene or 1-decene.

69. The fuel concentrate according to claim 68, wherein $R_4$ is a polyalkyl group derived from polyisobutene.

70. The fuel concentrate according to claim 69, wherein the polyisobutene contains at least about 20% of a methylvinylidene isomer.

71. The fuel concentrate according to claim 55, wherein R is amino, $R_1$, $R_2$ and $R_3$ are hydrogen and $R_4$ is a polyalkyl group derived from polyisobutene.

72. The fuel concentrate according to claim 55, wherein the fuel concentrate further contains from about 20 to about 60 weight percent of a fuel-soluble, nonvolatile carrier fluid.

73. The fuel concentrate according to claim 55, wherein the hydrocarbyl substituent on the aliphatic amine of component (b) has a number average molecular weight of about 450 to about 1,000.

74. The fuel concentrate according to claim 55, wherein the aliphatic amine of component (b) is a branched chain hydrocarbyl-substituted amine.

75. The fuel concentrate according to claim 74, wherein the aliphatic amine of component (b) is a polyisobutyl or polyisobutenyl amine.

76. The fuel concentrate according to claim 74, wherein the amine moiety of the aliphatic amine is derived from a polyamine having from 2 to 12 amine nitrogen atoms and from 2 to 40 carbon atoms.

77. The fuel concentrate according to claim 76, wherein the polyamine is a polyalkylene polyamine having 2 to 12 amine nitrogen atoms and 2 to 24 carbon atoms.

78. The fuel concentrate according to claim 77, wherein the polyalkylene polyamine is selected from the group consisting of ethylene diamine, diethylene triamine, triethylene tetramine and tetraethylene pentamine.

79. The fuel concentrate according to claim 78, wherein the polyalkylene polyamine is ethylene diamine or diethylene triamine.

80. The fuel concentrate according to claim 79, wherein the aliphatic amine of component (b) is a polyisobutenyl ethylene diamine.

81. The fuel concentrate according to claim 75, wherein the aliphatic amine of component (b) is a polyisobutyl monoamine.

* * * * *